US005921668A

United States Patent [19]

Bayer

[11] Patent Number: 5,921,668

[45] Date of Patent: Jul. 13, 1999

[54] SCULPTED ORNAMENTAL ARRANGEMENT FOR CHANDELIERS

[75] Inventor: Georg Bayer, Plattsburgh, N.Y.

[73] Assignee: Schonbek Worldwide Lighting, Inc., Plattsburgh, N.Y.

[21] Appl. No.: 08/816,543

[22] Filed: Mar. 13, 1997

[51] Int. Cl.[6] ..... F21S 1/04

[52] U.S. Cl. ..... 362/404; 362/806

[58] Field of Search ..... 362/404, 405, 362/806

[56] References Cited

U.S. PATENT DOCUMENTS

| | | | |
|---|---|---|---|
| 3,943,353 | 3/1976 | Tada | 362/806 |
| 5,109,325 | 4/1992 | Bayer et al. | 362/433 |
| 5,144,541 | 9/1992 | Schonbek | 362/806 |
| 5,205,644 | 4/1993 | Bayer et al. | 362/405 |
| 5,222,805 | 6/1993 | Schonbek et al. | 362/405 |
| 5,241,460 | 8/1993 | Schonbek | 362/405 |
| 5,285,364 | 2/1994 | Bayer | 362/405 |

FOREIGN PATENT DOCUMENTS

| | | | |
|---|---|---|---|
| 1063847 | 3/1967 | United Kingdom | 362/405 |
| 1270677 | 4/1972 | United Kingdom | 362/405 |
| 9119934 | 12/1991 | WIPO | 362/405 |

*Primary Examiner*—Laura Tso
*Attorney, Agent, or Firm*—Wolf, Greenfield & Sacks, P.C.

[57] ABSTRACT

An ornamental sculpted arrangement having a plurality of ornaments interconnected by a plurality of elongated frame members. The frame members have a backbone extending the length of the frame member and include a series of prearranged attachment arts each of which couples an ornament to the frame member. Ornaments are interposed between and connected to adjacent frame members to form a mesh or net of ornaments. The mesh of ornaments may be sculpted, the shape of which is determined by the distance between neighboring attachment arts, the dimension of the ornaments and the shape of the backbone. This enables the resulting sculpture to take on any desired configuration or shape, and the resulting sculpture is not influenced by gravity. The frame members are preferably formed of a material that enables the backbone to be shape to form a desired sculpted appearance. The attachment arts may be positioned in any desire arrangement on the backbone. This arrangement of alternating frame members and ornaments may be of any length and width, and may include ornaments of any dimensions spaced relative to each other at predetermined distances by the attachment arts, resulting in a desired sculpted arrangement.

28 Claims, 5 Drawing Sheets

SCULPTED ORNAMENTAL ARRANGEMENT FOR CHANDELIERS

BACKGROUND OF THE INVENTION

1. Field of The Invention

The present invention relates generally to chandeliers and, more particularly, to sculpted ornamental arrangements for chandeliers and other lighting fixtures.

2. Related Art

A chandelier is typically formed of a framework from which a plurality of glass or crystal ornaments are suspended to form an overall ornamental appearance of the chandelier. The glass ornaments are typically attached to a metal wire having a hook at one end that passes loosely through a hole in the crystal and a hook at the other end that passes through a hole in the chandelier framework. An exemplary conventional chandelier framework having several ornamental strings hanging from the framework is shown in FIG. 1 (prior art). The conventional chandelier framework 100 includes a central post 102 carrying at its base lighting elements 104. Extending outwardly from the central post 102 is a plurality of spokes 106 which support rings 108. The rings 108, in turn, support a plurality of ornaments 110. The ornaments 110 are loosely attached to hooks 112 which are looped through openings 114 in the rings 108. Although numerous chandelier designs have been developed with these hanging ornamental strings, these designs are limited in that only a single orientation of the ornamental strings is possible. In addition, this orientation is determined solely by ordinary gravitational forces.

A very early improvement to ornamental chandelier design was the creation of strings of crystal ornaments having a plurality of crystal ornaments held together end-to-end by a series of clips or "bow ties." These strings of crystal ornaments were also suspended from the chandelier framework. Although numerous chandelier designs were made possible by this conventional arrangement, these designs were subject to the same drawback as that noted above: the orientation of the ornamental strings were determined solely by gravitational forces.

U.S. Pat. No. 5,109,325 to Bayer et al., assigned to the assignee of the present invention, represents an important advance in the art of chandelier design. This patent teaches an arrangement whereby the face of an individual crystal may be positioned at virtually any angle. In this arrangement, the chandelier hook is not fitted loosely through a hole in the crystal ornament, but instead is glued to the ornament. As a result, the face of the crystal ornament is fixed relative to the orientation of the shaft of the hook. A particular hook/frame engagement mechanism is also provided whereby the hook shaft may be positioned, for example, horizontally with respect to the chandelier frame, rather than simply being suspended vertically as in prior conventional designs. An example of this arrangement is shown in FIG. 2 (prior art), wherein a ring 202 is shown with a crystal ornament 204 attached to the ring 202 by a rigid hook 206. The rigid hook 206 is glued in a bore (not shown) in the crystal ornament 204, and has a fixed angular relationship to the crystal ornament 204. The rigid hook 206 engages openings 208A, 208B in the ring 202, whereby the rigid hook 206 is held fixed with respect to the ring 202 and extends radially outward in a horizontal direction therefrom. Although the ability to suspend the face of a crystal at a particular angle with respect to the chandelier frame provides the ability to create "sculpted" chandelier designs having a shape unaffected by gravity, there are a number of drawbacks to such arrangements. These include, for example, the difficulty and cost of manufacturing multiple components and the limited arrangements available due to the shape and size of the rigid hooks 206.

U.S. Pat. No. 5,241,460 to Schonbek, assigned to the assignee of the present invention, represents another important advance to the art of chandelier designs. This patent teaches the use of spring tensioned strings of ornaments whereby the ornamental strings are held in a fixed, predetermined pattern against gravitational forces. In this design, individual crystal ornaments are loosely attached to one another by clips or bow ties, each having a pair of hooks. One hook of each pair passes loosely through an opening in adjacent crystal ornaments. Either end of the string of crystals is then attached to a rigid frame member of the chandelier. A spring is attached to the resulting string at any number of locations, tensioning the crystal ornament string into a predetermined pattern. An example of such an arrangement is shown in FIG. 3 (prior art), wherein a chandelier having a central post 302 with a plurality of spokes 304 extending from the central post 302 is shown. Attached to the spokes are rings 306 for supporting ornaments 308. The ornaments 308 are arranged as a string of ornaments with adjacent ends of the ornaments held together by hooks 310A. One end of the string of ornaments is fixed to the lower ring by a terminal hook 310B. The other end of the string of ornaments is attached to the upper ring 306 by a spring 312. The spring 312 tensions the string of ornaments to hold it in a predetermined pattern which opposes the forces of gravity. Although this approach provides for the creation of sculpted designs far beyond those previously available, the manufacture of such a chandelier is cumbersome in that crystal ornaments need to be attached to each other via the bow ties and then secured to the chandelier frame with the springs. In addition, this design is time consuming and expensive to manufacture and also time consuming to assemble. Furthermore, the process of repair and cleaning is difficult, particularly if it is necessary to access the internal region of the bowl formed by the crystals.

SUMMARY OF THE INVENTION

It is an object of the invention to provide an ornamental sculpted arrangement that is flexible in design yet simple to manufacture, assemble and maintain.

Another object of the invention is to create a lighting ornament framework, wherein the position of the ornaments is largely independent of gravity.

Another object of the invention is to provide an ornamental arrangement that contains a minimal number of components that are inexpensive to manufacture.

Another object of the invention is to create a sculpted arrangement of lighting fixture ornaments which are stable in an unstable environment such as on a boat.

These and other objectives are met by the present invention which involves an ornamental sculpted arrangement having a plurality of ornaments interconnected by a plurality of frame members. The frame members have an elongate backbone and include a series of attachment arms extending from the backbone. Each of the attachment arms couples an ornament to the frame member. Ornaments are interposed between and connected to adjacent frame members to form a mesh of ornaments. The mesh of ornaments may be sculpted, the shape of which is determined by a number of design characteristics including the distance between neighboring attachment arms and the shape of the backbone. Significantly, this enables the resulting sculpture to take on any desired configuration or shape having a taper, concavity or convexity introduced by the interaction between attachment arm configurations and ornament size. In addition, the relative position of the ornaments in the resulting sculpture is maintained regardless of the orientation of the arrangement.

According to one aspect of the invention a lighting fixture is provided. The lighting fixture has rows of ornaments and frame members. Each of the frame members has an elongate backbone and attachment arms extending from the backbone. Each row of ornaments is positioned between adjacent frame members and is attached to a pair of the attachment arms. One attachment arm of the pair extends from one frame member and the other attachment arm of the pair extends from the adjacent frame member. This arrangement forms a mesh of ornaments held together by the frame members. An outwardly-facing surface of the ornaments and an outwardly-facing surface of the frame members form a continuous outer shape of the lighting fixture. The distance between adjacent frame members may be substantially constant or differentially altered along a lengthwise axis of the adjacent frame members.

According to another aspect of the invention, a lighting fixture is provided. The lighting fixture includes a plurality of elongate frame members having a plurality of attachment arms, each of which is attached to an ornament. The frame members interconnect one or more pairs of ornaments to form a mesh of interconnected ornaments. Each of the frame members are axially rigid and laterally flexible thereby enabling the ornament mesh to be shaped to form a desired ornamental sculpture. The mesh may include ornaments having a plurality of sizes or the ornaments may all be the same size. In addition, the distance between adjacent frame members may the same or differentially altered along a lengthwise axis of the adjacent frame members. An outwardly-facing surface of the ornaments and an outwardly-facing surface of the frame members form a continuous outer shape of the lighting fixture.

According to another aspect of the invention, a mesh of interconnected ornaments is provided. The mesh includes a plurality of elongate frame members having a plurality of attachment arts each attached to one ornament of a row of ornaments to form a sculpted arrangement of alternating ornament rows and frame members. An outwardly-facing planar face of the frame members and an outwardly-facing surface of the ornaments define a continuous shape of the sculpted arrangement.

According to yet another aspect of the invention, a chandelier component is provided. The chandelier component includes frame members and ornaments attached to the frame members. The frame members each have an elongate backbone and attachment arms extending from the backbone. Rows of ornaments are positioned between adjacent frame members. A pair of attachment arms are attached to each ornament of a row of ornaments. One of the attachment arms of the pair extends from one of the adjacent frame members and the other attachment arm of the pair extends from the adjacent frame member to form a mesh of ornaments held together by the frame members. The distance between adjacent frame members may be differentially altered along a lengthwise axis of the frame members to create a desired shape. An outwardly-facing surface of the ornaments and an outwardly-facing surface of the frame members form a continuous outer shape of the chandelier component.

According to yet another aspect of the invention, a chandelier is provided. The chandelier includes alternating rows of ornaments and frame members. Each of the frame members has an elongate backbone with attachment arms extending therefrom. Each row of ornaments is positioned between adjacent frame members with a pair of the attachment arms attached to each ornament. The pair of attachment arms includes one attachment arm extending from one of the adjacent frame members and the other attachment arm extending from the adjacent frame member. This arrangement forms a mesh of ornaments held together by the frame members.

The mesh may include ornaments having a plurality of sizes or the ornaments may all be the same size. The adjacent frame members are separated by a distance that may the same or differentially altered along the lengthwise axis of the adjacent frame members. In one embodiment, the distance between adjacent frame members is altered due to the size of the ornament. In another embodiment, the distance between adjacent frame members is altered due to changes in the length of the attachment arms. In still another embodiment, the distance between adjacent frame member is altered due to changes in both the length of the attachment arms and the size of the ornaments. An outwardly facing surface of the ornaments and an outwardly-facing surface of the frame members form a continuous outer shape of the ornamental mesh.

The invention also involves methods for constructing chandeliers. According to one aspect of the invention, two frame members are provided, each with an elongate backbone defining a lengthwise axis. The backbones have first and second opposing sides substantially parallel with the lengthwise axis and a plurality of attachment arms extending from each of the opposing sides of the frame members. Ornaments are attached to each of the attachment arms extending from the first opposing side of a first frame member to form a first row of ornaments. The row of ornaments are then attached to each of the attachment arms extending from the second opposing side of a second frame member. Preferably, the ornaments are loosely secured to the frame members during the above method. This process is continued to form a mesh of alternating ornament rows and frame members. The mesh is preferably flexed to form a desired sculpted appearance.

The backbone may take on any desired form to accommodate the selected size of the ornaments and the desired distance between the attachment arm pairs. For example, in one aspect of the invention the backbone is a narrow, linear member. In another aspect of the invention, the backbone is sized to consume a portion of the space between adjacent ornaments. In addition, the backbone may be any desired shape, such as an oval or polygon, may be solid or hollow and may be filled with a substance or have an ornamental setting to achieve a desired appearance.

In still yet another embodiment of the invention, the attachment arms are arranged to form a step-like or layered effect. For example, in one aspect of the invention the attachment arms are positioned on opposing sides of the backbone; that is, one extending from a visible surface and one extending from a hidden surface of the backbone. This step-like arrangement of ornaments may extend the plane of the ornamental mesh away from or towards the viewer to provide a 3-dimensional effect. The extent of this effect is determined by the number of adjacent frame members that continue the step-like pattern.

The attachment arms members are preferably integral extension arms configured to pass through a corresponding hole in an associated ornament. The portion of the attachment arm that extends through the ornament is bent during manufacturing to loosely secure an ornament to the frame member. Other attachment means are also contemplated.

In all of the foregoing embodiments, each elongate frame member is preferably formed from a material that is axially rigid yet flexible along its length to enable the frame members to conform to a desired sculpted shape and to maintain that shape regardless of the orientation of the arrangement and the size and weight of the interconnected ornaments. The ornaments can be glass ornaments and preferably are crystal ornaments. The ornaments, of course, can be made of virtually any material. The lighting fixtures are preferably chandeliers.

Further features and advantages of the present invention as well as the structure and operation of various embodiments of the present invention are described in detail below with reference to the accompanying drawings. In the drawings, like reference numerals indicate like or functionally similar elements. Additionally, the left-most one or two digits of a reference numeral identifies the drawing in which the reference numeral first appears.

BRIEF DESCRIPTION OF THE DRAWINGS

This invention is pointed out with particularity in the appended claims. The above and further advantages of this invention may be better understood by referring to the following description when taken in conjunction with the accompanying drawings, in which:

DETAILED DESCRIPTION

Figure 1:
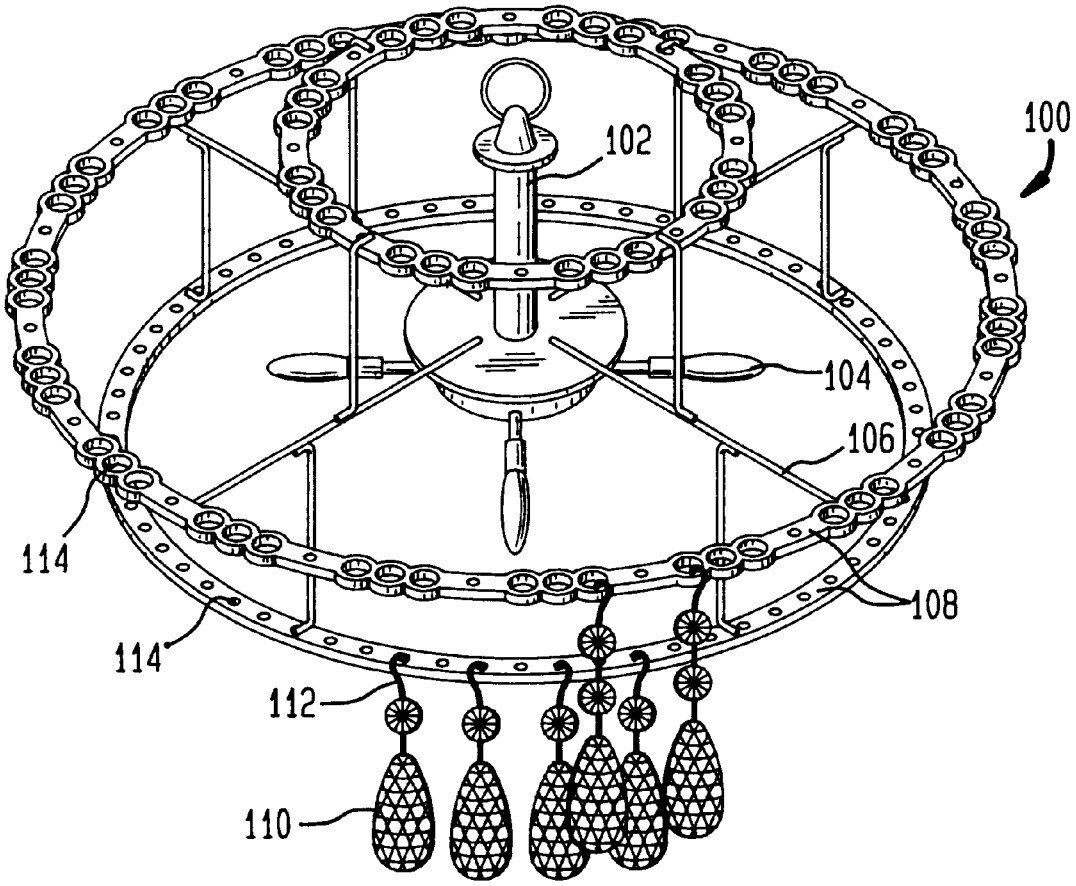
FIG. 1 (PRIOR ART)
FIG. 1 is a perspective view of a conventional chandelier having gravitationally-suspended strings of crystals.
Figure 2:
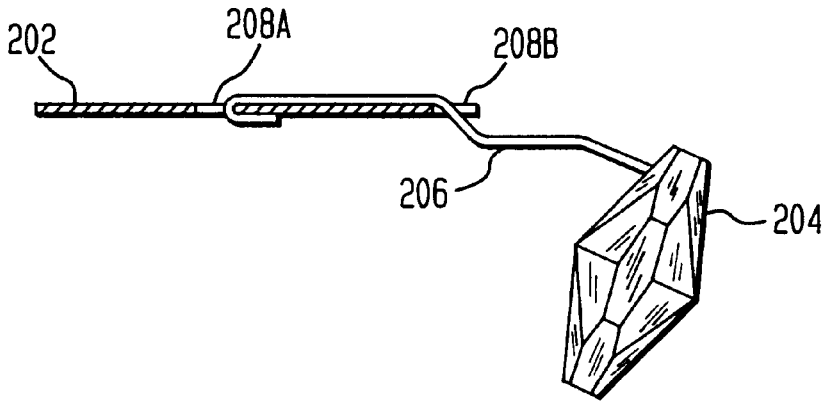
FIG. 2 (PRIOR ART)
FIG. 2 is a perspective view of a conventional chandelier having chandelier hooks with a crystal ornament glued to one end such that the face of the crystal is fixed relative to the orientation of the shaft of the hook.
Figure 3:
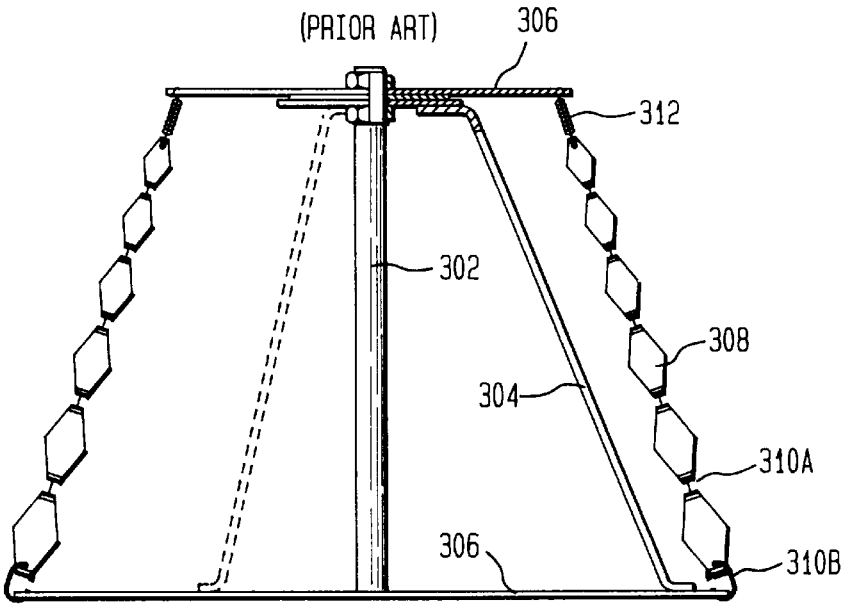
FIG. 3 (PRIOR ART)
FIG. 3 is a perspective view of a conventional chandelier having spring tensioned strings of ornaments held in a predetermined pattern.
Figure 4:
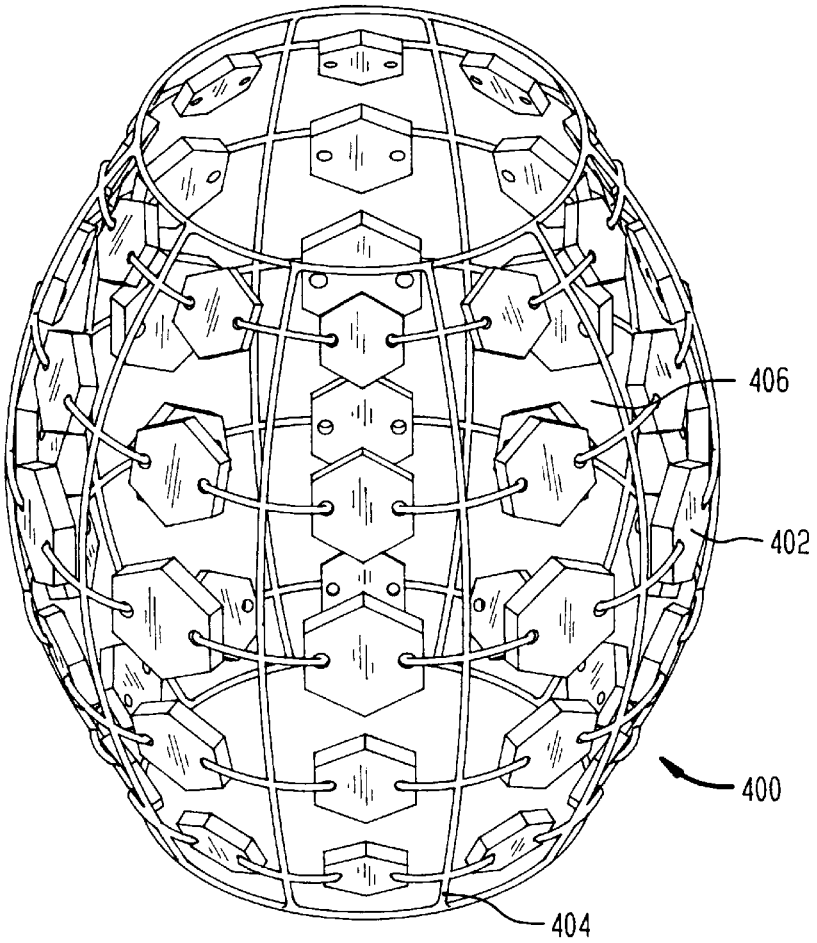
FIG. 4 is a perspective view of one embodiment of the an ornamental sculpture configured with an ornamental mesh of the present invention.

The present invention relates generally to chandeliers and, more particularly, to ornamental arrangements for chandeliers and other lighting fixtures. FIG. 4 is a perspective view of an exemplary embodiment of an ornamental arrangement 400 created with an ornamental mesh of the present invention. The ornamental arrangement 400 includes a plurality of ornaments 402 interconnected by a plurality of elongate frame members 404. The outer shape of the ornamental arrangement 400 is formed from a continuous mesh 406 of alternating ornament rows and frame members. Each ornament 402 of an ornament row is attached to adjacent frame members 404 which maintain the orientation of the ornaments 402 regardless of the orientation of the ornamental arrangement 400.

Figure 5A:
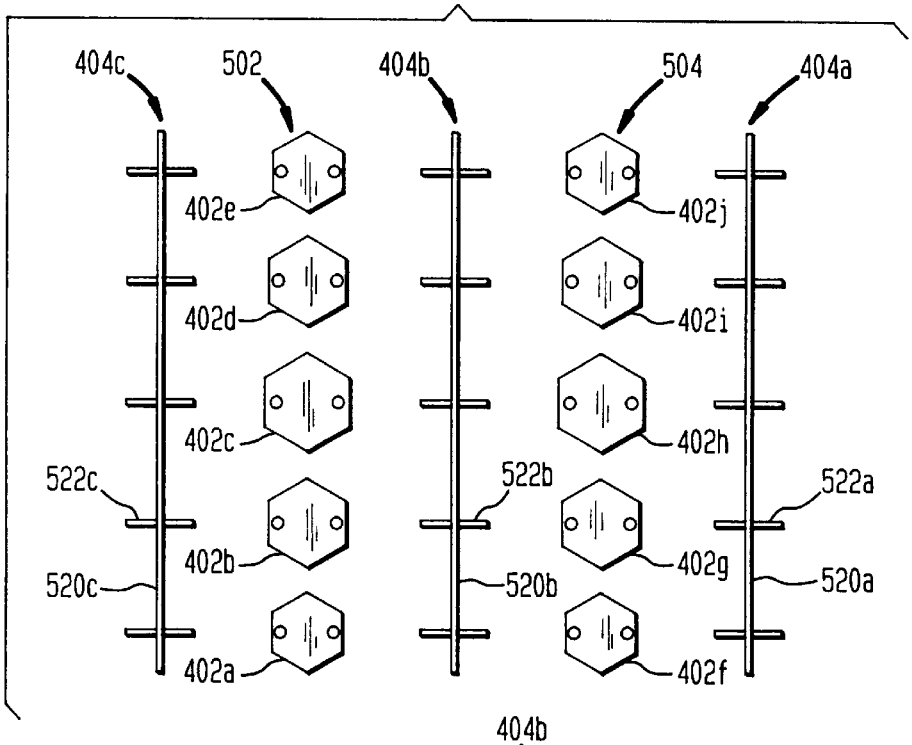
FIG. 5A is a perspective view of an unassembled portion of a portion of an ornament mesh of the present invention.
Figure 5B:
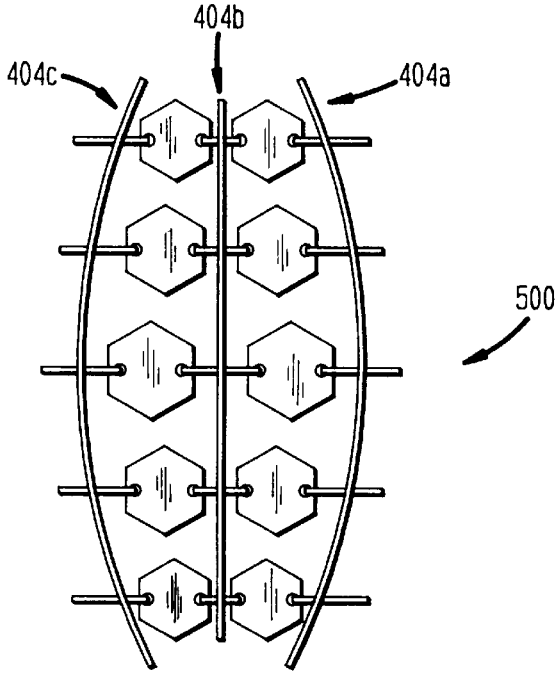
FIG. 5B is a perspective view of an assembled portion of an ornamental mesh of the present invention.

FIGS. 5A and 5B illustrate a perspective view of a portion 500 of ornament mesh 406. In FIG. 5A, the portion 500 is shown unassembled while FIG. 5B the elements shown in FIG. 5A are assembled in accordance with the present invention. The portion 500 of ornamental mesh 406 includes a plurality of ornaments 402 generally arranged in rows 502, 504. Interposed between each ornament row 502, 504 is an elongate frame member 404. Three such frame members 404A, 404B, 404C are illustrated in FIGS. 5A and 5B. Ornament row 502 is interposed between adjacent frame members 404B and 404C while ornament row 504 is interposed between adjacent frame members 404A and 404B. For ease of illustration, the frame members 404A–404C are shown schematically in FIGS. 5A and 5B.

Frame members 404 include an elongate backbone 520A–C and a plurality of attachment arms 522A–C extending from the backbone 520. Each of the attachment arms 522A–C couples an ornament to its respective backbone 520A–C. The attachment arms 522 preferably extend from opposing sides of the frame member backbone 520 and extend along a lengthwise axis of the frame member defined by the elongate backbone 520. Preferably, each frame member 404 is a single piece of material, with the attachment arms 522 contiguous with the elongate backbone 520.

Figure 6:
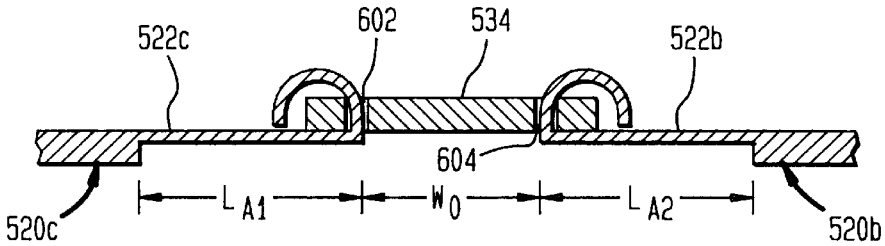
FIG. 6 is a cross-sectional view of an ornament and a preferred embodiment of an associated pair of attachment arms.

Each ornament 402 is associated with, and attached to, a pair of attachment arms 522. For example, ornament 402A in ornament row 502 is associated with (and in FIG. 5B, attached to), and an attachment arm 522C on frame member 404C and attachment arm 522B on frame member 404B. The manner in which the ornaments 402 are connected to the frame members 404 is now described with reference to FIG. 6. FIG. 6 is a cross-sectional view of ornament 402A and attachment arms 522C, 522B taken along dashed sectional line "FIG. 6" shown in FIG. 5B. FIG. 6 also illustrates the length of the attachment arms and the width of the ornaments as defined in accordance with the present invention.

The attachment arms 522B, 522C are preferably bendable, integral extensions continuous with the backbone and constructed and arranged to pass through a corresponding thru-hole 602, 604 in an associated ornament 402A. The portion of the attachment arms 522 that extends through the ornament 402A are bent during manufacturing to attach the associated ornament 402A to the frame members 404B and 404C.

The width $W_O$ of the ornament 402A is defined by the location of the thru-holes 602, 604. That is, the width $W_O$ of the ornament 402A is determined by the portion of the ornament 402A between the point at which the ornament 402A attaches to the attachment arms 522. Likewise, the length of the attachment arms 522B, 522C is determined by the location on the attachment arms at which the ornament 402 is attached. In the embodiment illustrated in FIG. 6, the length $L_{A1}$ and $L_{A2}$ of the attachment arms 522B, 522C is determined by the curvature in the attachment arms to pass the distal end of the attachment arms 522B, 522C respectively, through thru-holes 602, 604. Thus, the distance between flexible adjacent frame members 404 is the sum of the attachment arm lengths and ornament width ($L_{A1}+W_O+L_{A2}$).

Referring to FIGS. 5B and 6, the shape of the ornamental mesh is determined by the extent to which the distance between parallel adjacent flexible frame members 404 is differentially altered along the length of the frame members. This distance can be affected by a number of interdependent variables, including as alterations in the width of the ornaments and alterations in the length of the attachment arms. If the sum of the pairs of attachment arm lengths and ornament width remain constant, the shape of the ornamental mesh will be substantially flat. If this sum varies, then the frame members 404 will be stressed into a non-planar arrangement.

The degree to which the ornamental mesh is non-planar will depend on the differences in these sums and the longitudinal spacing between attachment arm pairs. Virtually any shape is possible. Flat shapes may involve ornaments of only a single size and attachment arms of only a single size. Either the ornament size or the attachment arm size can be varied with a corresponding inverse variance in the other to maintain a flat arrangement. Thus, so long as the combination of the width of the ornament 402 and the length of the attachment arms 522 remains constant, the elongated backbones 520 remain substantially planar and parallel.

Curved shapes may involve ornaments of successively increasing size and attachment arms of only a single size. Alternatively, the attachment arms may be successively increasing in length while the ornament size remains the same. Further, the ornament size and the attachment arm length can be simultaneously increased to achieve a desired curvature. Any of the these variations will result in the combination of the width of the ornament and the length of the attachment arms increasing, causing the elongated backbones to flex into a non-planar arrangement having any desired taper, concavity or convexity. Referring to FIG. 5B, for example, the ornamental mesh 500 has a curved shape due to the different size ornaments 402A–402J. Each ornament row 502, 504 has five ornaments. In each row, the ornaments are successively larger along the lengthwise axis of the frame members 404 from the ends to the center of the illustrated portion 500 shown in FIG. 5B. The attachment arms 522 of the frame members 404A–404C are the same length along the lengthwise axis of the frame members 404. As a result, the increasing size of the ornaments 402 cause the frame members 404A–404C to flex into the curved shape shown in FIG. 5B.

Figure 7A:
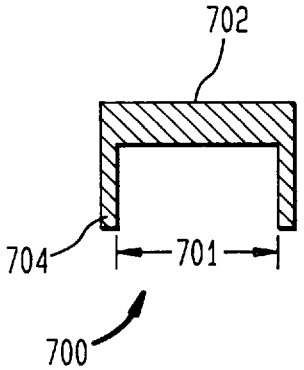
FIGS. 7A, 7B and 7C illustrate a cross-sectional, top and side view, respectively, of an exemplary embodiment of the frame member of the present invention.
Figure 7B:
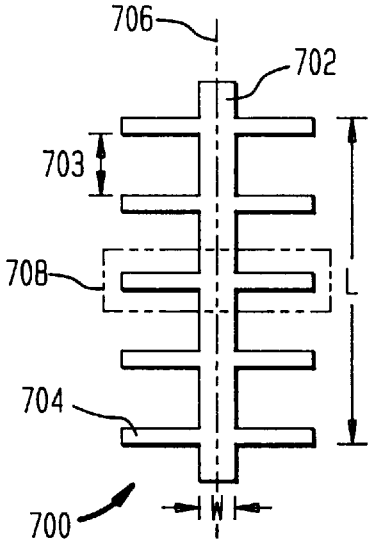
Figure 7C:
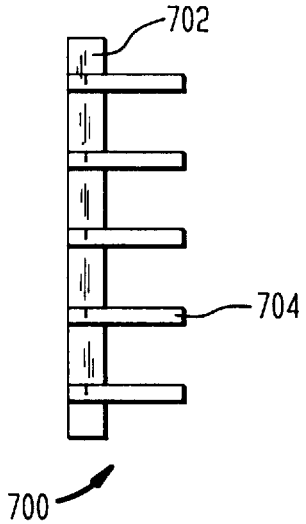

The frame members 404 will now be described in greater detail with reference to two illustrative embodiments shown in FIG. 7A through FIG. 8C. A cross-sectional, top and side view of an exemplary embodiment of the frame member of the present invention is illustrated in FIGS. 7A, 7B and 7C, respectively. The elongated frame member 700 includes a backbone 702 and integral attachment arms 704 that serve to attach ornaments 402 (not shown) to the frame member 700. In the illustrative embodiment, the backbone 702 is a substantially flat elongate material having a width W that is substantially smaller than its length L as shown in FIG. 7B, and a substantially rectangular cross-section as shown in FIG. 7A. A lengthwise axis 706 extends the length L of the frame member 700 through the approximate center of the elongated backbone 702.

In the aspect of the invention illustrated in FIGS. 7A–7C, the attachment arms 704 are arranged in laterally-adjacent pairs 708 along the length of the backbone 702. Each attachment arm 704 couples an ornament 402 to the backbone 702.

The longitudinal distance 703 (see FIG. 7B) between adjacent attachment arm pairs 708 may be constant or variable, depending upon the size of the associated ornaments 402, the location at which the frame member 702 is connected to the ornament 402, and the desired space between longitudinally-adjacent ornaments. In the exemplary frame member 700, the distance 703 between adjacent attachment arm pairs 708 is substantially constant as shown in FIGS. 7B and 7C. This distance, along with the dimension of the ornaments and the shape of the backbone 702, determines the shape of the resulting ornamental mesh in the longitudinal direction.

Likewise, the lateral distance 701 (see FIG. 7A) between the attachment arms 704 of each attachment arm pair 708 may be constant or variable, depending upon the size of the associated ornaments 402, the location at which the attachment arm 702 is connected to the ornament 402 and the desired space between laterally-adjacent ornaments. This distance is also constant in the exemplary frame member 700. This distance determines the shape of the sculpted ornamental mesh in the lateral direction.

Figure 8A:
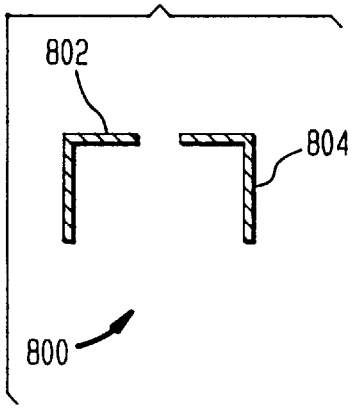
FIGS. 8A, 8B and 8C illustrate a cross-sectional, top and side view, respectively, of another exemplary embodiment of the frame member of the present invention.

The backbone may take on any desired form to accommodate the selected size of the ornaments 402 and the desired distance between the attachment arms. For example, in frame member 700 the backbone 702 is a narrow, linear member connecting adjacent attachment arm pairs 708. An alternative exemplary embodiment of the frame member of the present invention having a shaped configuration is shown in FIGS. 8A–8C.

Figure 8B:
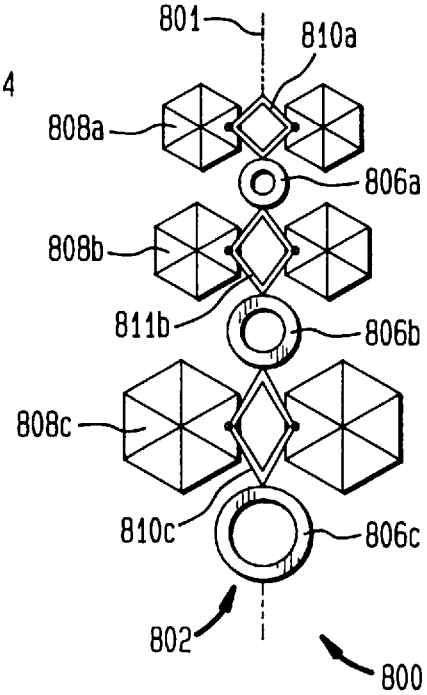
Figure 8C:
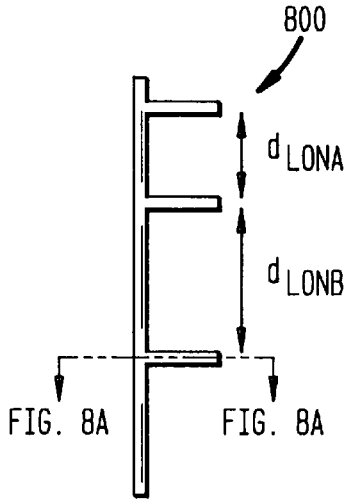

Referring to the top view of frame member 800 illustrated in FIG. 8B, segments 806A, 806B and 806C of the backbone 802 have a shape that laterally extends from the center line 801 of the backbone 802 to consume a portion of the space between longitudinally-adjacent ornaments 808A, 808B and 808C. As shown in FIG. 8B, ornaments 808A–808C increase in size successively. Accordingly, in this illustrative example, segments 806A–806C are also successively increasing in size to increase the distance between longitudinally-adjacent attachment arms 804. In addition, segments 810A–810C are progressively larger to increase the distance between laterally adjacent ornaments 808 to accommodate the increasing size of the ornaments.

It should be noted that the shapes of segments 806 and 810 are for illustration only. The backbone segments may be any desired shape. Also, the backbone may be hollow as shown in FIGS. 8A and 8B, or may be solid. In addition, the backbone segments may be filled with a substance, have an ornamental setting or be configured in any other manner to achieve a desired visual effect.

The attachment arms may have any desired relative position. For example, referring to FIGS. 7A–7C, the attachment arms 704 of each attachment arm pair 708 is laterally aligned with each other, resulting in substantially linear rows of ornaments when viewed across multiple frame members 700. Alternatively, the attachment arms may be longitudinally offset relative to each other. In such an arrangement, the resulting ornamental mesh includes ornaments laterally arranged in diagonal or zig-zag patterns rather than substantially linear rows when viewed across multiple frame members.

Returning to FIG. 5, it is preferable that the attachment arms 522 loosely attach the ornaments 402 to the frame members 404 to enable them to shift to accommodate the shape of the resulting ornamental mesh 500. It should be noted, however, that other alternative means for loosely attaching the ornaments 402 to the frame member 404 are contemplated and considered to be within the scope of the present invention.

Figure 9A:
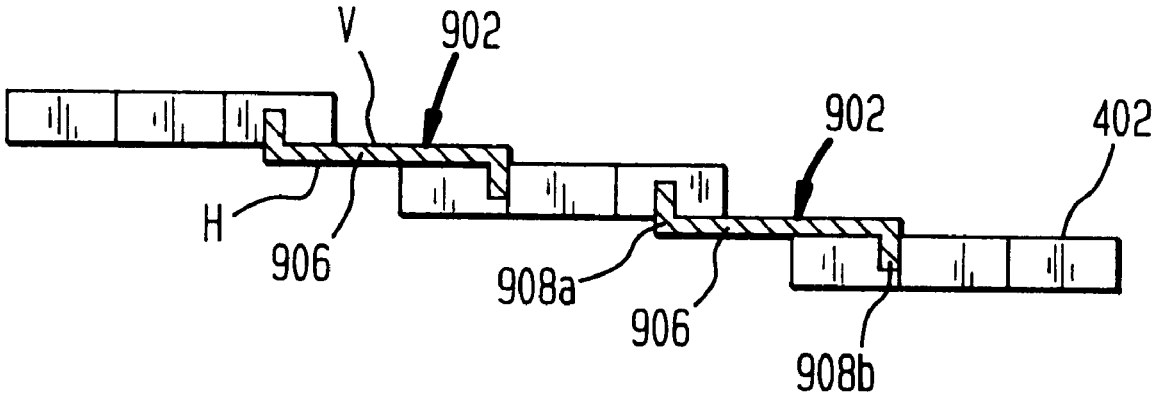
FIG. 9A is a cross-sectional view of one embodiment of the frame member of the present invention with laterally-separated attachment arms extending from opposite planar sides of the backbone.
Figure 9B:
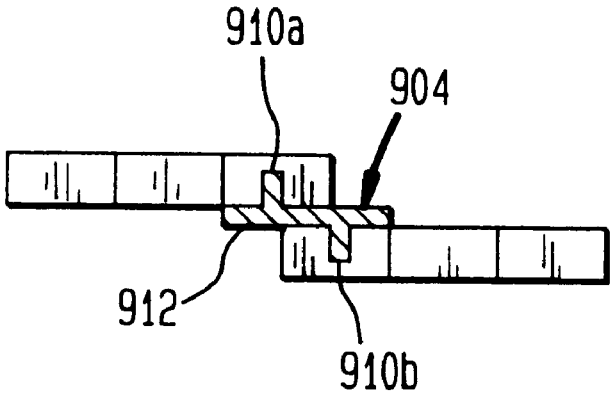
FIG. 9B is a cross-sectional view of one embodiment of the frame member of the present invention with laterally-aligned attachment arms extending from opposite planar sides of the backbone.

FIGS. 9A and 9B illustrate an alternative embodiment of the present invention. In contrast to the above arrangements, the attachment arms of each attachment arm pair are arranged to extend from opposing sides of the backbone. Referring to FIG. 9A, the frame members 902 include a backbone 906 having substantially planar opposing visible (V) and hidden (H) sides. One attachment arm 908A extends from the visible side of the backbone 906 whereas the attachment arm 908B extends from the hidden side of the backbone 906. The resulting step-like arrangement of ornaments 402 may extend the plane of the ornamental mesh away from or towards the viewer to provide a 3-dimensional effect. The extent of this effect is determined by the number of adjacent frame members 902 that continue the step-like pattern.

The lateral distance between the attachment arms 908 of each attachment arm pair in such an embodiment is as large as the width of the backbone 902 in the exemplary embodiment shown in FIG. 9A. Alternatively, the lateral distance between the attachment arms may be less than that shown in FIG. 9A, as shown in the exemplary embodiment illustrated in FIG. 9B. Referring to FIG. 9B, the attachment arms 910A and 910B extend from the visible (V) and hidden (H) sides, respectively, of the backbone 912. However, the attachment arms 910A and 910B are positioned closer to the center of the backbone 912, resulting in laterally-adjacent ornaments that overlap with each other, providing a layered effect that significantly shields the backbone 912 from view. It should be understood that the attachment arms may extend from the backbone at any location and in any manner.

Returning again to FIGS. 5A and 5B, it is preferable that the attachment arms 522 loosely attach the ornaments 402 to the frame members 404 to enable the ornaments to shift to accommodate the shaping of the resulting ornamental mesh 500. It should be noted, however, that other alternative means for attaching the ornaments 402 to the frame member 404 are contemplated and considered to be within the scope of the present invention.

Preferably, each elongated frame member is formed from a single piece of material that is axially rigid yet is flexible along its length to enable the frame members to conform to the desired sculpted shape while simultaneously maintaining that shape regardless of the orientation of the sculpture and the size and weight of the interconnected ornaments. It should be clear from the preceding description that each of the frame members described herein can be constructed relatively easily using computer-aided design techniques in conjunction with automated metal-stamping or cutting equipment. In particular, it is contemplated that a laser cutter of conventional design can be programmed to form frame members from sheet material stock. Such a laser cutters can be supplemented with a punch mechanism that forms holes of desired shape in the backbone. Additionally, variety of thicknesses, hardnesses and grades of metal can be utilized according to this invention. Additionally, polymers and plastics can be substituted for any of the materials used herein. Likewise, frame members can be manufactured from non-metallic materials. It is contemplated generally that the frame members should be sufficiently resilient and long-lived for use with chandelier ornament arrangements. Likewise, the frame members should be sufficiently stiff so that the chandelier frame does not experience misalignment and the frame members do not, themselves, deform under force applied by the ornaments.

While various embodiments of the present invention have been described above, it should be understood that they have been presented by way of example only, and not limitation. Thus, the breadth and scope of the present invention are not limited by any of the above-described exemplary embodiments, but are defined only in accordance with the following claims and their equivalents.

What is claimed is:

1. A lighting fixture comprising:

a plurality of frame members, each having an elongate backbone defining a lengthwise axis and attachment arms extending laterally from said backbone; and a plurality of rows of ornaments, each said row comprising a plurality of ornaments, wherein each said row of ornaments is positioned between adjacent frame members, two of said attachment arms attached to each ornament, one attachment arm extending from one of said adjacent frame members and the other attachment arm extending from the other of said adjacent frame members, thereby forming a mesh of ornaments held together by said plurality of frame members.

2. The lighting fixture of claim 1, wherein said plurality of ornaments comprise ornaments having a plurality of sizes.

3. The lighting fixture of claim 1, wherein said plurality of ornaments comprise a plurality of ornaments having a size that is substantially equal.

4. The lighting fixture of claim 2, wherein said plurality of adjacent frame members are separated by a distance, wherein said distance is differentially altered along said lengthwise axis of said adjacent frame members.

5. The lighting fixture of claim 3, wherein said adjacent frame members are separated by a distance, wherein said distance is substantially constant along the lengthwise axis of said adjacent frame members.

6. The lighting fixture of claim 1, wherein an outwardly facing surface of one of said plurality of rows of ornaments and an outwardly facing surface of said adjacent frame members between which said one of said plurality of rows of ornaments are substantially parallel.

7. The lighting fixture of claim 1, wherein one or more of said frame members are curved along said lengthwise axis.

8. The lighting fixture of claim 1, wherein said frame members are flexed out of a plane to form a sculpted fixture.

9. The lighting fixture of claim 1, wherein an outwardly facing surface of said ornaments and an outwardly-facing surface of said frame member form a contiguous outer shape of the lighting fixture.

10. The lighting fixture of claim 2, wherein said adjacent frame members are separated by a distance, wherein said distance is differentially altered along said lengthwise axis of said adjacent frame members.

11. A mesh of interconnected ornaments forming a desired ornamental sculpture, said mesh comprising:

a plurality of elongate frame members having a plurality of attachment arms each attached to an ornament, wherein said plurality of attachment arms include one or more pairs of first and second attachment arms each connected to an ornament, thereby interconnecting one of more ornaments to two or more frame members to form the mesh of interconnected ornaments, wherein each of said plurality of frame members are substantially flexible, thereby enabling said mesh to be shaped to form the ornamental sculpture.

12. The lighting fixture of claim 11, wherein said shape of said sculpture is determined by a size of the ornaments.

13. The lighting fixture of claim 11, wherein said shape of said sculpture is determined by a size of said attachment arms.

14. The lighting fixture of claim 11, wherein said shape of said sculpture is determined by locations on each of said plurality of ornaments at which said attachment arms are attached.

15. A mesh of interconnected ornaments comprising a plurality of elongate frame members having a plurality of attachment arms each attached to one ornament of a row of ornaments such that each ornament of said row of ornaments is connected to adjacent frame members to form a sculpted arrangement of alternating ornament rows and frame members wherein a planar face of said frame members and an outwardly-facing surface of said ornaments define a contiguous shape of said arrangement.

16. A chandelier component comprising:

frame members, each having an elongate backbone defining a lengthwise axis and attachment arms extending laterally from said backbone, a plurality of rows of ornaments, each said row comprising a plurality of ornaments, wherein each of said plurality of rows of ornaments is positioned between adjacent frame members, two of said attachment arms attached to each ornament, one attachment arm extending from one of said adjacent frame members and the other attachment arm extending from the other of said adjacent frame members, thereby forming a mesh of ornaments held together by said plurality of frame members.

17. The chandelier of claim 16, wherein said plurality of ornaments comprise ornaments having a plurality of sizes.

18. The chandelier of claim 16, wherein said adjacent frame members are separated by a distance, wherein said distance is differentially altered along said lengthwise axis of said adjacent frame members.

19. The chandelier of claim 16, wherein one or more of said frame members are curved along said lengthwise axis.

20. The chandelier of claim 16, wherein an outwardly facing surface of said ornaments and an outwardly-facing surface of said frame member form a contiguous outer shape of the chandelier component.

21. A chandelier comprising:

a plurality of frame members each having an elongate backbone and attachment arms extending laterally from said backbone, said backbone defining a lengthwise axis of said frame members, a plurality of rows of ornaments each positioned between substantially parallel adjacent frame members, two of said attachment arms attached to each ornament, one attachment arm extending from one of said adjacent frame members and the other attachment arm extending from the other of said adjacent frame members, thereby forming a mesh of ornaments held together by said plurality of frame members.

22. The chandelier of claim 21, wherein said ornaments comprise ornaments having a plurality of sizes.

23. The chandelier of claim 21, wherein said adjacent frame members are separated by a distance, wherein said distance is differentially altered along said lengthwise axis of said adjacent frame members.

24. The chandelier of claim 21, wherein an outwardly facing surface of said ornaments and an outwardly-facing surface of said frame member form a contiguous outer shape of the lighting fixture.

25. A method for constructing a lighting fixture comprising the steps of:

(a) providing a first frame member with a first elongate backbone defining a first lengthwise axis and having first and second opposing sides, and a plurality of first attachment arms extending from each of said opposing sides of said first frame member;

(b) providing a second frame member with a second elongate backbone defining a second lengthwise axis and having first and second opposing sides, and a plurality of second attachment arms extending from each of said opposing sides of said second frame member;

(c) attaching an ornament to each of said attachment arms extending from said first opposing side of said first frame member to form a first row of ornaments; and (d) attaching said ornaments of said first row of ornaments to each of said attachment arms extending from said second opposing side of said second frame member.

26. The method of claim 25, further comprising the step of:

(e) repeating said steps (a)–(d) to form a mesh of interconnected ornaments.

27. The method of claim 25, wherein said ornaments are loosely secured to said frame members.

28. The method of claim 26, further comprising the step of:

(f) flexing said mesh of ornaments to form a desired sculpted appearance.

* * * * *

UNITED STATES PATENT AND TRADEMARK OFFICE

CERTIFICATE OF CORRECTION

PATENT NO.: 5,921,668

DATED: July 13, 1999

INVENTOR(S): Georg Bayer

It is certified that error appears in the above-identified patent and that said Letters Patent is hereby corrected as shown below:

On the title page, item [57]

In the Abstract, line 5, replace "arts" with --arms--;

In the Abstract, line 15, replace "shape" with --shaped--;

In Figure 6, replace "534" with --402a--;

In Claim 11, line 63 replace "of" with --or--.

Signed and Sealed this

Eighteenth Day of January, 2000

*Attest:*

Q. TODD DICKINSON

*Attesting Officer*

*Commissioner of Patents and Trademarks*